US008802604B2

(12) United States Patent
Yagishita

(10) Patent No.: US 8,802,604 B2
(45) Date of Patent: Aug. 12, 2014

(54) LUBRICATING OIL COMPOSITION IN CONTACT WITH SILVER-CONTAINING MATERIAL

(75) Inventor: Kazuhiro Yagishita, Kanagawa (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 156 days.

(21) Appl. No.: 13/060,907

(22) PCT Filed: Aug. 20, 2009

(86) PCT No.: PCT/JP2009/064545

§ 371 (c)(1), (2), (4) Date: May 12, 2011

(87) PCT Pub. No.: WO2010/024170

PCT Pub. Date: Mar. 4, 2010

(65) Prior Publication Data

US 2011/0212863 A1 Sep. 1, 2011

(30) Foreign Application Priority Data

Aug. 29, 2008 (JP) ..... 2008-222280

(51) Int. Cl.
*C10L 1/22* (2006.01)
*C10M 137/10* (2006.01)

(52) U.S. Cl.
USPC ..... 508/192; 508/369

(58) Field of Classification Search
USPC ..... 508/192, 369
See application file for complete search history.

(56) References Cited

U.S. PATENT DOCUMENTS

| | | | | |
|---|---|---|---|---|
| 2,959,546 | A | 8/1960 | Versteeg | |
| 3,267,033 | A | 8/1966 | Allen | |
| 3,649,373 | A | 3/1972 | Dahms | |
| 3,775,321 | A | 11/1973 | Turnquest | |
| 4,169,799 | A | 10/1979 | Sung et al. | |
| 4,244,827 | A | 1/1981 | Michaelis et al. | |
| 4,278,553 | A | 7/1981 | Sung et al. | |
| 4,285,823 | A | 8/1981 | Sung et al. | |
| 4,575,431 | A | 3/1986 | Salentine | |
| 4,717,490 | A | 1/1988 | Salentine | |
| 4,764,296 | A | 8/1988 | Kennedy | |
| 4,820,431 | A | 4/1989 | Kennedy | |
| 5,244,591 | A | 9/1993 | Middleton | |
| 5,302,304 | A | 4/1994 | Valcho | |
| 6,569,818 | B2 * | 5/2003 | Nakazato et al. | 508/185 |
| 2003/0216266 | A1 * | 11/2003 | Hirano et al. | 508/291 |
| 2004/0259743 | A1 | 12/2004 | Butke | |
| 2005/0026791 | A1 | 2/2005 | Esche | |
| 2006/0270567 | A1 * | 11/2006 | Kurihara et al. | 508/192 |

FOREIGN PATENT DOCUMENTS

| | | | |
|---|---|---|---|
| CA | 810120 | A | 4/1969 |
| EP | 1 418 353 | A2 | 5/2004 |
| EP | 1 712 606 | A1 | 10/2006 |
| GB | 1 415 964 | A | 12/1975 |
| JP | 06-264110 | A | 9/1994 |
| JP | 07-151148 | A | 6/1995 |
| JP | 09-257045 | A | 9/1997 |
| JP | 10-061727 | A | 3/1998 |
| JP | 2000-240657 | A | 9/2000 |
| JP | 2002-195266 | A | 7/2002 |
| JP | 2002-294271 | A | 10/2002 |
| JP | 2005-068171 | A | 3/2005 |
| JP | 2005-220197 | A | 8/2005 |
| JP | 2007-023289 | A | 2/2007 |
| JP | 2008-248213 | A | 10/2008 |

OTHER PUBLICATIONS

International Search Report: PCT/JP2009/064545.
European Search Report; dated Jul. 12, 2012; Appln. No. 09809822.1—2104 / 2348093 PCT/JP2009064545.

* cited by examiner

*Primary Examiner* — Prem C Singh
*Assistant Examiner* — Francis C Campanell
(74) *Attorney, Agent, or Firm* — Ladas & Parry LLP

(57) ABSTRACT

The present invention provides a lubricating oil composition in contact with a silver-containing material, which comprises: a lubricant base oil made of a mineral base oil and/or a synthetic base oil; (A) metallic detergent; (B) one or more species of alkenyl succinimide and/or boron-containing alkenyl succinimide; and (C) zinc dialkyl dithiophosphate, wherein the content of these components to the total mass of the lubricating oil composition are defined as, (A) component: 0.12-2.0 mass % as metal content; (B) component: 0-0.03 mass % as boron content, 0.005 mass % to less than 0.08 mass % as nitrogen content, and the mass ratio (B/N) between the boron content (B) and the nitrogen content (N) is 0-0.55; and (C) component: 0.005-0.10 mass % as phosphorous content. As a lubricating oil in contact with silver-containing material, the lubricating oil composition can inhibit sulfidation corrosion of silver while containing zinc dialkyl dithiophosphate.

4 Claims, No Drawings

LUBRICATING OIL COMPOSITION IN CONTACT WITH SILVER-CONTAINING MATERIAL

TECHNICAL FIELD

The present invention relates to a lubricating oil composition in contact with silver-containing material.

BACKGROUND ART

Recently, in view of improving performances of engine, such as high power output and low fuel consumption, cylinder pressure of engine tends to be raised. Since engine bearing requires improvement of bearing performance under high surface pressure, lead-containing material has been widely used as a sliding bearing. However, usage of lead is restricted as it is an environmentally hazardous substance. So, lead-free high-performance bearing is demanded.

With respect to the bearing for high-load engine, usage of a silver material for overlay and liner has been examined. For example, in diesel engine for railway cars in other countries, silver alloy is sometimes used for piston pin bearing and turbo charger bearing. Moreover, silver-containing material and silver-plating material is sometimes used for not only overlay and liner but also sliding surface of the portion other than bearing, as a solid lubrication film (for example, refer to Patent documents 1 to 6).

In other countries, for diesel engine for railway car, many studies about lubricating oil which is applicable for the silver-containing material have been done (refer to Patent documents 7 to 25). For instance, Patent document 7 discloses a zinc-free lubricating oil containing: a hydrocarbon amine salt of dialkyl dithiophosphoric acid; a hydrocarbon amine salt of acidic alkyl phosphate; and a detergent, as a lubricating oil suitably used for high-load engine using silver-containing material, wherein the detergent is particularly preferably a phenate detergent. In this way, in other countries, to the devices using silver-containing material, zinc dialkyl dithiophosphate-free lubricating oil has been applied.

In these days in Japan, to the ball bearing used at the sliding portion of connecting-rod bearing of two-wheel vehicles, for the purpose of inhibiting abrasive wear, silver plating or copper plating having a thickness of more than a dozen micrometers has been given on the surface of the iron-based material as the base material. The silver plating and copper plating have excellent property in small fatigue phenomenon; however, its sulfidation corrosion is large, which is problematic. The actual corrosion is controlled by many elements thereby the mechanism is complex; but, it is known that the main cause of sulfidation corrosion is attributed to sulfur-containing compounds such as zinc dialkyl dithiophosphate contained in the engine oil. In general, so as to inhibit sulfidation corrosion, corrosion inhibitor such as benzotriazole is used. The corrosion inhibitor such as benzotriazole is useful for inhibiting sulfidation corrosion of copper; however, it has been discovered that it is not sufficiently effective for inhibiting corrosion of silver. Therefore, as a lubricating oil composition in contact with a silver member, a zinc dialkyl dithiophosphate-free lubricating oil composition is proposed (see Patent document 26).

Nevertheless, in view of anti-wear property and antioxidant characteristic, zinc dialkyl dithiophosphate is an essential component for lubricating oil for internal combustion. Therefore, development of lubricating oil composition which contains zinc dialkyl dithiophosphate and which can inhibit sulfidation corrosion of silver has been a big issue.

Patent Document 1: Japanese Patent Application Laid-Open (JP-A) No. 2002-195266
Patent Document 2: JP-A No. 2000-240657
Patent Document 3: JP-A No. 10-061727
Patent Document 4: JP-A No. 09-257045
Patent Document 5: JP-A No. 07-151148
Patent Document 6: JP-A No. 06-264110
Patent Document 7: JP-A No. 2007-023289
Patent Document 8: British Patent No. 1415964
Patent Document 9: Canadian Patent No. 810120
Patent Document 10: U.S. Pat. No. 2,959,546
Patent Document 11: U.S. Pat. No. 3,267,033
Patent Document 12: U.S. Pat. No. 3,649,373
Patent Document 13: U.S. Pat. No. 3,775,321
Patent Document 14: U.S. Pat. No. 4,169,799
Patent Document 15: U.S. Pat. No. 4,244,827
Patent Document 16: U.S. Pat. No. 4,278,553
Patent Document 17: U.S. Pat. No. 4,285,823
Patent Document 18: U.S. Pat. No. 4,575,431
Patent Document 19: U.S. Pat. No. 4,717,490
Patent Document 20: U.S. Pat. No. 4,764,296
Patent Document 21: U.S. Pat. No. 4,820,431
Patent Document 22: U.S. Pat. No. 5,244,591
Patent Document 23: U.S. Pat. No. 5,302,304
Patent Document 24: US Patent Application Laid-open (US-A) No. 2004/0259743
Patent Document 25: US-A No. 2005/0026791
Patent Document 26: JP-A No. 2002-294271

DISCLOSURE OF THE INVENTION

Problems to be Solved by the Invention

Accordingly, an object of the present invention is to provide a lubricating oil composition, as a lubricating oil in contact with a silver-containing material, which contains zinc dialkyl dithiophosphate and which can inhibit corrosion of silver-containing material.

Means for Solving the Problems

As a result of intensive study about corrosion of silver by the inventor, he discovered that a lubricating oil composition, which contains specific amounts of a specific metallic detergent and an alkenyl succinimide having a specific B/N ratio, can inhibit corrosion/corrosive-wear of a silver-containing metal material while containing zinc dialkyl dithiophosphate. Then, he completed the following invention.

The first aspect of the invention is a lubricating oil composition in contact with a silver-containing material, which comprises: a lubricant base oil made of a mineral base oil and/or a synthetic base oil; (A) metallic detergent; (B) one or more species of alkenyl succinimide and/or boron-containing alkenyl succinimide; and (C) zinc dialkyl dithiophosphate, wherein the content of these components to the total mass of the lubricating oil composition are defined as, (A) component: 0.12-2.0 mass % as metal content;

(B) component: 0-0.03 mass % as boron content, 0.005 mass % to less than 0.08 mass % as nitrogen content, and the mass ratio (B/N) between the boron content (B) and the nitrogen content (N) is 0-0.55; and (C) component: 0.005-0.10 mass % as phosphorous content.

In the first aspect of the invention, mass ratio (M/N) between the metal content (M) attributed to the (A) component and the nitrogen content (N) attributed to the (B) component is preferably 1.6 or more.

In the first aspect of the invention, the (A) component is preferably selected from the group consisting of: alkali metal phenate, alkali earth metal phenate, alkali metal salicylate, and alkali earth metal salicylate.

In the first aspect of the invention, sulfur content in the lubricant base oil is preferably less than 50 ppm.

The second aspect of the invention is a method for protecting a silver-containing material in contact with a lubricating oil, the method comprising the step of: bringing a lubricating oil composition according to the first aspect of the invention as a lubricating oil into contact with a silver-containing material.

Effects of the Invention

Since the lubricating oil composition of the invention can inhibit corrosion of the silver which the lubricating oil composition is in contact with, when using the lubricating oil composition as a lubricating oil, it is possible to protect silver-containing material as well as machines and devices including silver-containing material. In addition, since the lubricating oil composition contains zinc dialkyl dithiophosphate, it is possible to inhibit sulfidation corrosion while maintaining the anti-wear property and the antioxidant characteristic. Therefore, the lubricating oil composition can be suitably used as a lubricating oil for various internal combustions: particularly diesel engine; diesel engine for railway car; gasoline engine for automobile; and four-cycle two-wheel vehicle engine.

BEST MODE FOR CARRYING OUT THE INVENTION

Hereinafter, the lubricating oil composition of the present invention will be described in detail.

(Lubricant Base Oil)

As the lubricant base oil used for the lubricating oil composition of the present invention (hereinafter, simply referred to as "lubricating oil composition"), as long as it is a mineral base oil and/or a synthetic base oil used for normal lubricating oil, any kind of lubricant base oil can be used without specific restriction.

As the mineral base oil, specifically, there may be: an oil obtained by refining a lubricating oil fraction, which is obtained by vacuum distillation of topped crude obtained by topping of crude oil, by using one or more treatment such as solvent deasphalting, solvent extraction, hydrocracking, solvent dewaxing, and hydrorefining; a wax-isomerized mineral oil; and a lubricant base oil produced by isomerization of GTL WAX (Gas to Liquid Wax) manufactured by Fischer-Tropsch process.

The total aromatic fraction of the mineral base oil, but not specifically limited, is preferably 40 mass % or less, more preferably 30 mass % or less. When the total aromatic fraction of the base oil exceeds 40 mass %, oxidation stability of the lubricating oil composition is deteriorated; hence it is not preferable.

Since usage of the below-described (A) component and (B) component enables to attain sufficient inhibiting effect of silver corrosion, as a mineral base oil which is advantageous in terms of solubility of the additives and economic efficiency, a mineral base oil of which total aromatic fraction is 10 mass % or more, preferably 20 mass % or more, may be used. In view of excellent oxidation stability in severer condition and capability of inhibiting corrosion of silver which is caused by a component attributed to the deterioration of the mineral oil with long-term use, a mineral base oil of which total aromatic fraction is less than 10 mass %, preferably 5 mass % or less, more preferably 2 mass % or less is desirably used.

It should be noted that the "total aromatic fraction" means the content of aromatic fraction measured in accordance with ASTM D2549. Usually, the aromatic fraction includes: not only alkyl benzene and alkyl naphthalene; but also anthracene, phenanthrene, and the alkylated product thereof; compounds in which four or more benzene rings are condensed; and compounds having heteroaromatic compound(s) such as pyridines, quinolines, phenols, and naphthols.

Sulfur content in the mineral base oil, but not specifically limited, is preferably 1 mass % or less, more preferably 0.7 mass % or less. Since usage of the below-described (A) component enables to attain sufficient inhibiting effect on silver corrosion, as a mineral base oil which is advantageous in terms of solubility of the additives and economic efficiency, a mineral base oil of which sulfur content is 0.1 mass % or more, preferably 0.2 mass % or more may be used. In view of excellent oxidation stability in severer condition and capability of inhibiting corrosion of silver which is caused by a component attributed to the deterioration of the mineral oil with long-term use, a mineral base oil of which sulfur content is less than 0.1 mass %, preferably 0.05 mass % or less, and more preferably less than 0.005 mass % (less than 50 ppm) is desirably used.

Specific examples of synthetic base oil include: polybutene or the hydrogenated product thereof; poly-α-olefin such as 1-octene oligomer, 1-decene oligomer, and 1-dodecene oligomer, or the hydrogenated product thereof; diester such as ditridecyl glutalate, di-2-ethylhexyl adipate, diisodecyl adipate, ditridecyl adipate, and di-2-ethylhexyl sebacate; polyol ester such as trimethyloipropane caprylate, trimethylolpropane pelargonate, pentaerythritol-2-ethylhexanoate, and pentaerythritol pelargonate; copolymer of dicarboxylic acids such as dibutyl maleate and $C_2$-$C_{30}$ α-olefin; and aromatic synthetic oil such as alkyl naphthalene, alkyl benzene, aromatic ester or the mixtures thereof.

The above poly-α-olefin or the hydrogenated product thereof can be particularly preferably used in view of excellent oxidation stability in a severer condition and capability of inhibiting corrosion of silver caused by a component attributed to the deterioration of the mineral oil with long-term use.

In the invention, as a lubricant base oil, mineral base oils, synthetic base oils, or mixture of two or more species of lubricating oils selected from these base oils can be used. For example, one or more species of mineral base oil, one or more species of synthetic base oil, or a mixed oil containing one or more species of mineral base oils and one or more species of synthetic base oils.

The kinematic viscosity of the lubricant base oil of the invention is not specifically limited. The kinematic viscosity at 100° C. is preferably 4-50 $mm^2/s$, more preferably 4.5-40 $mm^2/s$, and particularly preferably 5-35 $mm^2/s$. Here, the kinematic viscosity at 100° C. means a kinematic viscosity at 100° C. defined by JIS (Japanese Industrial Standards) K2283. When the kinematic viscosity at 100° C. of the lubricant base oil exceeds 50 $mm^2/s$, the property of cold-temperature viscosity is deteriorated; while, when the kinematic viscosity is less than 4 $mm^2/s$, the lubricity is poor at the area to be lubricated due to the insufficient oil film formation and the evaporation loss of the lubricant base oil becomes larger. So, the both cases are not preferable.

Viscosity index of the lubricant base oil of the present invention is not specifically limited; in view of obtaining excellent viscosity characteristics from low temperature to high temperature, it is preferably 80 or more, more preferably 90 or more, and further more preferably 95 or more. The upper limit of the viscosity index is not specifically limited. Examples of the base oil may be: base oils having a viscosity index of about 120-160 such as hydrocracked mineral oil, poly-α-olefin base oil (for example, oligomer of α-olefin such as 1-octene, 1-decene, and 1-dodecene, or the hydrogenated product thereof); base oils having a viscosity index of about 135-180 such as n-paraffin, slack wax, and GLT wax, or iso-paraffinic mineral oil obtained by isomerizing these base oils; and other base oils having a viscosity index of about 150-250 such as complex ester base oil or HVI-PAO base oil.

((A) Metallic Detergent)

The lubricating oil composition of the present invention contains a metallic detergent as the (A) component. Examples of metallic detergent, but not limited to, include: a known alkali metal or alkali earth metal sulfonate detergent, alkali metal or alkali earth metal phenate detergent, alkali metal or alkali earth metal salicylate detergent, alkali metal or alkali earth metal naphthenate detergent, alkali metal or alkali earth metal phosphonate detergent, and the mixture of two or more thereof (including complex-type). Among them, phenate detergent or salicylate detergent is preferable.

Here, the alkali metal includes sodium and potassium; and the alkali earth metal includes calcium, magnesium, and barium. Among such metals, alkali earth metals are preferable; calcium or magnesium is particularly preferable. The total base number and additive amount of these metallic detergents can be selected depending on the required performance of the lubricating oil.

It should be noted that the metallic detergent not only contains neutral metallic detergent but also contains over-based/basic metallic detergent; in the invention, it is preferably an over-based/basic metallic detergent containing calcium carbonate and/or calcium borate.

The base-number of the metallic detergent is not particularly limited; it is usually preferably 0-500 mgKOH/g, more preferably 150-450 mgKOH/g, and particularly preferably 200-400 mgKOH/g. The "base-number" means a base-number as measured by perchloric acid method in accordance with No. 7 in JIS K 2501 "Petroleum products and lubricating oil—Determination of neutralization number".

In the invention, the content of the (A) metallic detergent contained in the resin composition is not specifically restricted; to the total mass of the composition, as the metal content, the (A) metallic detergent is preferably 0.12-2.0 mass %, more preferably 0.13-1.0 mass %, furthermore preferably 0.14-0.8 mass %, still further more preferably 0.15-0.6 mass %, and most preferably 0.15-0.4 mass %. When the (A) metallic detergent is less than 0.12 mass % as the metal content, corrosive-wear inhibiting effect of the silver-containing material tends to be insufficient; when the (A) metallic detergent exceeds 2.0 mass % as the metal content, increase of combustion chamber deposit by high ash content and adverse influence to the exhaust-gas treatment equipment tend to be caused.

((B) Component)

The lubricating oil composition contains alkenyl succinimide and/or boron-containing alkenyl succinimide as the (B) component.

The alkenyl succinimide is a succinimide compound having at least one $C_{40-400}$, preferably $C_{60-350}$ linear or branched alkyl group or alkenyl group in the molecule. When the carbon number of the alkyl group or the alkenyl group is less than 40, solubility of the compound to the lubricant base oil tends to be deteriorated; while, when the carbon number of the alkyl group or the alkenyl group exceeds 400, low temperature fluidity of the lubricating oil composition tends to be deteriorated. The alkyl group or alkenyl group may be liner or branched. Preferable examples thereof include: oligomer of olefin such as propylene, 1-butene, and isobutene; branched alkyl group or branched alkenyl group derived from a co-oligomer of ethylene and propylene.

Examples of the alkenyl succinimide in the invention may be a mono-type succinimide of the following formula (1) in which succinic anhydride is added at one end of polyamine at a time of imidization, and/or a bis-type succinimide of the following formula (2) in which succinic anhydride is added at both ends of the polyamine. In view of high-temperature detergency, bis-type succinimide is preferable.

(Formula 1)

(1)

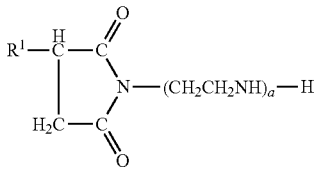

-continued (Formula 2)

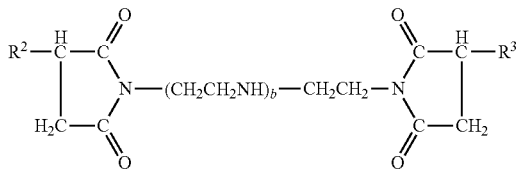

(2)

In the formulae (1) and (2), $R^1R^2$, and $R^3$ are independently a $C_{40-400}$, preferably $C_{60-350}$ linear or branched alkyl group or alkenyl group; a is an integer of 1 to 10, preferably 2 to 5; b is an integer of 1 to 10, preferably 2 to 5.

The method for producing the above alkenyl succinimides is not particularly limited. For example, these alkenyl succinimides can be obtained by reacting polyamine with alkyl succinic acid or alkenyl succinic acid obtained by reacting maleic anhydride with a compound having a $C_{90-400}$ alkyl group or alkenyl group at 100-200° C.

Examples of polyamine include: diethylene triamine, triethylene tetramine, tetraethylene pentamine, and pentaethylene hexamine.

The boron-containing alkenyl succinimide can be obtained by reacting alkenyl succinimides of the formulae (1) and (2) with a boron compound such as boric acid, borate salt or borate ester. Examples of boric acid may be: ortho-boric acid, metha-boric acid, or tetra-boric acid.

As an alkenyl succinimide in the invention, boron-containing alkenyl succinimide or boron-free alkenyl succinimide can be used. In view of seizure resistance, a boron-containing alkenyl succinimide is preferable; in view of sludge dispersancy, sustainability of high-temperature detergency, and economic efficiency, a boron-free alkenyl succinimide is preferable.

In the invention, the content of the (B) alkenyl succinimide and/or boron-containing alkenyl succinimide, to the total mass of the composition, as boron content, is 0-0.03 mass %; the upper limit is preferably 0.025 mass % or less, more preferably 0.024 mass % or less, and further more preferably 0.023 mass % or less. The nitrogen content is 0.005 mass % to less than 0.08 mass %, preferably 0.01-0.075 mass %, more preferably 0.02-0.07 mass %. Mass ratio (B/N ratio) between the boron content (B) and the nitrogen content (N) is 0-0.55; the upper limit is preferably 0.50 or less, more preferably 0.45 or less. When the boron content exceeds 0.03 mass % or the B/N ratio exceeds 0.55, the corrosive-wear inhibiting effect of the silver-containing material tends to be insufficient.

The mass ratio (M/N) between metal content (M) attributed to the (A) metallic detergent and the nitrogen content (N) attributed to the (B) alkenyl succinimide is preferably 1.6 or more, more preferably 2.0 or more, and further more preferably 2.4 or more. When the M/N ratio is less than 1.6, the corrosive-wear inhibiting effect of the silver-containing material tends to be insufficient.

((C) Component)

The lubricating oil composition of the invention contains zinc dialkyl dithiophosphate as (C) component.

Examples of zinc dialkyl dithiophosphate in the invention may be the one represented by the following formula (3)

(Formula 3)

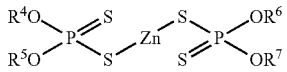

(3)

In the formula, $R^4$, $R^3$, $R^6$, and $R^7$ are independently a $C_{1-24}$ hydrocarbon group. Examples of the $C_{1-24}$ hydrocarbon group include: a $C_{1-24}$ linear or branched alkyl group, a $C_{3-24}$ linear or branched alkenyl group, a $C_{5-13}$ cycloalkyl group or $C_{5-13}$ linear or branched alkyl cycloalkyl group, a $C_{6-18}$ aryl group or $C_{6-18}$ linear or branched alkyl aryl group, and a $C_{7-19}$ aryl alkyl group. The alkyl group and alkenyl group may be primary, secondary, and tertiary.

Among the hydrocarbon group which can be $R^4$, $R^5$, $R^6$, and $R^7$, the hydrocarbon group is particularly preferably a linear or branched $C_{1-18}$ alkyl group or a $C_{8-18}$ aryl group, or a linear or branched alkyl aryl group.

The method for producing the zinc dialkyl dithiophosphate, but not particularly limited, may be a known method. For example, it can be obtained by firstly reacting diphosphorus pentasulfide with alcohols or phenols each having a hydrocarbon group corresponding to $R^4$, $R^5$, $R^6$, and $R^7$ to produce dithiophosphoric acid, and by neutralizing the dithiophosphoric acid with zinc oxide. The structure of the zinc dialkyl dithiophosphate depends on the alcohol to be used.

The content of zinc dialkyl dithiophosphate in the lubricating oil composition of the invention, as phosphorous content, is 0.005-0.10 mass %, preferably 0.01-0.098 mass %, and more preferably 0.02-0.095 mass %. When the lower limit of the phosphorous content is less than 0.005 mass %, the anti-wear property and the antioxidant characteristic tend to be insufficient; while, when the upper limit of the phosphorous content exceeds 0.10 mass %, corrosive-wear inhibiting effect of the silver-containing material tends to be insufficient.

By having the above structure, the lubricating oil composition of the present invention is excellent in anticorrosive property of silver-containing material. So, as a lubricating oil in contact with silver-containing material, the lubricating oil composition can inhibit corrosion, corrosive wear, elution, and the like of silver-containing material when a silver-containing material is used for machines or devices, particularly internal combustion. So as to further enhance the performance, or depending on the purpose, any kind of additives conventionally used for lubricating oil can be added to the lubricating oil composition of the invention. Examples of the additives include: antioxidant, anti-wear agent (or extreme pressure agent), friction modifier, viscosity index improver, corrosion inhibitor, rust inhibitor, demulsifier, metal deactivator, defoamant, and coloring agent.

As the antioxidant, ashless antioxidant such as phenolic antioxidant and aromatic aminic antioxidant, or metal antioxidant can be used. Among them, phenolic antioxidant and aromatic aminic antioxidant are preferable; particularly, bisphenolic antioxidant or phenolic antioxidant having ester bond is preferable; specifically, 3,5-dialkyl-4-hydroxyphenyl substituted fatty acid esters (wherein, one of the alkyl groups is tert-butyl and the remaining alkyl groups are respectively methyl or tert-butyl) such as octyl-3-(3,5-di-tert-butyl-4-hydroxyphenyl) propionate or octyl-3-(3-methyl-5-tert-butyl-4-hydroxyphenyl) propionate are preferable.

In the lubricating oil composition of the invention, when using the antioxidant, the content to the total mass of the composition is usually 0.1-5 mass %, preferably 0.5-2 mass %.

As the anti-wear agent (or extreme pressure agent), any kind of anti-wear agent conventionally used for lubricating oil can be used. For instance, sulfur-based, phosphorous-based, and sulfur-phosphorous-based extreme pressure agent can be used. Specific examples include: phosphite esters, thiophosphite esters, dithiophosphite esters, trithiophosphite esters, phosphate esters, thiophosphate esters, dithiophosphate esters, trithiophosphate esters, and amine salts thereof, metal salts thereof, derivatives thereof, dithiocarbamate, disulfides, polysulfides, olefin sulfides, and oil sulfide.

In the lubricating oil composition of the invention, when using these anti-wear agent (or extreme pressure agent), the content is not particularly limited; to the total mass of the composition, it is usually 0.01-5 mass %.

Examples of the friction modifier include: ashless friction modifier such as a fatty acid ester-based friction modifier, an aliphatic amine-based friction modifier, and a fatty acid amide-based friction modifier; and metal friction modifier such as molybdenum dithiocarbamate and molybdenum dithiophosphate can be used. The content to the total mass of the composition is usually 0.01-5 mass %.

Examples of the viscosity index improver include: polymethacrylate-based viscosity index improver, olefin copolymer-based viscosity index improver, styrene-diene copolymer-based viscosity index improver, styrene-maleic anhydride ester copolymer-based viscosity index improver, and polyalkylstyrene-based viscosity index improver. The mass-average molecular mass of the viscosity index improver is usually 800-1,000,000, preferably 100,000-900,000. The content of the viscosity index improver, to the total mass of the composition, is usually 0.1-20 mass %.

Examples of corrosion inhibitor include benzotriazole-based, thiadiazole-based, and imidazole-based compounds.

Examples of rust inhibitor include: petroleum sulfonate, alkyl benzene sulfonate, dinonylnaphthalene sulfonate, alkenyl succinate, and polyvalent alcohol ester.

Examples of demulsifier include: polyalkylene glycolic nonionic surfactant such as polyoxyethylene alkylether, polyoxyethylene alkylphenylether, and polyoxyethylene alkylnaphthyl ether.

Examples of metal deactivator include: imidazoline, pyrimidine derivatives, alkylthiadiazole, mercapto benzothiazole, benzotriazole or derivatives thereof, 1,3,4-thiadiazole polysulfide, 1,3,4-thiadiazolyl-2,5-bisdialkyl dithiocarbamate, 2-(alkyldithio)benzimidazole, and β-(o-carboxybenzylthio) propionitrile.

Examples of the defoamant include: silicone oil; alkenyl succinic acid derivatives; ester of polyhydroxy aliphatic alcohol and long-chain fatty acid; methylsalicylate; o-hydroxybenzyl alcohol; aluminum stearate; potassium oleate; N-dialkyl-allylamine nitroaminoalkanol; aromatic amine salt of isoamyloctyl phosphate; alkylalkylene diphosphate; metal derivatives of thioether; metal derivatives of disulfide; fluorine compounds of aliphatic hydrocarbon; triethyl silane; dichlorosilane; alkylphenyl polyethyleneglycol ethersulfide; and fluoroalkylether.

When adding these additives to the lubricating oil composition of the invention, to the total mass of the composition, the content of the corrosion inhibitor, the rust inhibitor, and the demulsifier are respectively 0.005-5 mass %, and the content of the metal deactivator is usually 0.005-1 mass %, and the content of the defoamant is usually 0.0005-1 mass %.

The kinematic viscosity at 100° C. of the lubricating oil composition of the invention containing the above components is 5.6-21.3 $mm^2/s$, preferably 5.6-16.3 $mm^2/s$.

(Silver-Containing Material)

The lubricating oil composition of the invention can inhibit corrosion of silver, so it can be suitably used for a lubricating oil in contact with silver-containing material. The silver-containing material is not particularly limited as long as silver exists in the metal surface which is in contact with the lubricating oil composition. The silver-containing material is not only made of silver itself, but also made of silver alloy or a silver-coated or silver-alloy-coated metal material, such as silver plating. The silver-containing material includes a case where a non-silver-containing material is coated on the surface of the base material but the coating surface is worn when used and the silver-containing material is exposed, thereby there is a possibility to contact with the lubricating oil composition of the invention. Moreover, the silver-containing material include not only a silver-containing material used for a sliding portion but also a silver-containing material, used for other than sliding portion, in contact with the lubricating oil composition Examples of silver alloy include: silver-tin alloy, silver-copper alloy, silver-tin-copper alloy, silver-aluminum alloy, silver-aluminum-silicon alloy, silver-aluminum-tin alloy, silver-aluminum-copper alloy, silver-aluminum-silicon-tin alloy, silver-aluminum-silicon-copper alloy, silver-aluminum-tin-copper alloy and silver-aluminum-silicon-tin-copper alloy. These silver-containing materials may be the one of which silver content is preferably 1 mass % or more, more preferably 2 mass % or more, further more preferably 5 mass % or more, and still further more preferably 10 mass % or more.

Specific examples of the silver-containing material include: a silver-tin alloy containing silver at a ratio of 50-95 mass %, preferably 60-90 mass %; a silver-copper-containing alloy containing silver at a ratio of 5-50 mass %, preferably 10-30 mass %; and a silver-aluminum-containing alloy containing silver at a ratio of 1-10 mass %, preferably 2-5 mass %. The larger amount of silver the metal surface contains, the more the corrosive-wear of silver tends to occur. Therefore, the lubricating oil composition of the invention is useful.

The lubricating oil composition of the invention is excellent in corrosion/corrosive-wear inhibiting effect of materials such as lead and copper as well as silver-containing material or silver plated material. So, it is not only useful for various silver-containing material, but also useful for machines and devices in which silver-containing material and lead-containing material or copper-containing material are separately contact with the lubricating oil.

Since the lubricating oil composition of the invention can inhibit corrosion of the silver-containing material which the lubricating oil composition is in contact with, when using the lubricating oil composition as a lubricating oil, it is possible to protect silver-containing material as well as machines and devices containing silver-containing material. In addition, since the lubricating oil composition contains zinc dialkyl dithiophosphate, it is possible to inhibit sulfidation corrosion while maintaining the anti-wear property and the antioxidant characteristic. Therefore, the lubricating oil composition can be suitably used as lubricating oil for various internal combustions: particularly diesel engine; diesel engine for railway car; gasoline engine for automobile; and four-cycle two-wheel vehicle engine.

EXAMPLES

Hereinafter, the present invention will be more specifically described by way of the following examples. However, the invention is not limited by the examples.

Examples 1-9, Comparative Examples 1-5

Additives: (A), (B), and (C) components are added to each of three base oils to prepare lubricating oil compositions having the compositions shown in Table 1 (Examples 1-9, Comparative examples 1-5). The amount of each additive is based on the total mass of the composition.

With respect to the obtained compositions as test oil, oxidation stability test was carried out under the following conditions in accordance with JIS K 2514 ("Lubricating oils for internal combustion-Determination of oxidation stability"; Indiana Stirring Oxidation Test (ISOT test)); then, the amount of silver eluted into the test oil were measured. The obtained results are also shown in Table 1.

Test piece: silver-plated test piece (0.5 mm×30 mm×30 mm)

Test temperature: 150° C.

Test time: 90 hours

Amount of test oil: 250 g

TABLE 1

| | | Example 1 | Example 2 | Example 3 | Example 4 | Example 5 | Example 6 | Example 7 | Example 8 |
|---|---|---|---|---|---|---|---|---|---|
| Lubricant base oil 1 (※1) | mass % | remaining part | remaining part | remaining part | remaining part | remaining part | remaining part | remaining part | |
| Lubricant base oil 2 (※2) | mass % | | | | | | | | remaining part |
| Lubricant base oil 3 (※3) | mass % | | | | | | | | |
| (A-1) Metallic detergent (※4) | mass % | 2.7 | 1.8 | 1.8 | 1.8 | 1.8 | — | — | 1.8 |
| equivalent to Ca element | mass % | 0.3 | 0.21 | 0.21 | 0.21 | 0.21 | — | — | 0.21 |
| (A-2) Metallic detergent (※5) | mass % | — | — | — | — | — | 2.34 | — | — |
| equivalent to Ca element | mass % | — | — | — | — | — | 0.21 | — | — |
| (A-3) Metallic detergent (※6) | mass % | — | — | — | — | — | — | 3.5 | — |
| equivalent to Ca element | mass % | — | — | — | — | — | — | 0.21 | — |
| (B-1) Succinimide (※7) | mass % | — | — | 1.4 | — | 4 | 4 | 4 | — |
| (B-2) Boric acid-modified succinimide (※8) | mass % | 4 | 4 | — | 2 | — | — | — | 4 |
| (B-3) Boric acid-modified succinimide (※9) | mass % | — | — | 2.6 | — | — | — | — | — |
| (B-4) Boric acid-modified succinimide (※10) | mass % | — | — | — | — | — | — | — | — |
| equivalent to nitrogen (N) element | mass % | 0.05 | 0.05 | 0.07 | 0.025 | 0.07 | 0.07 | 0.07 | 0.05 |
| equivalent to boron (B) element | mass % | 0.02 | 0.02 | 0.023 | 0.01 | 0 | 0 | 0 | 0.02 |
| B/N ratio | | 0.40 | 0.40 | 0.33 | 0.40 | 0.00 | 0.00 | 0.00 | 0.40 |
| M/N ratio | | 6.0 | 4.2 | 3.0 | 8.4 | 3.0 | 3.0 | 3.0 | 4.2 |
| (C-1) Zinc dialkyl dithiophosphate (※11) | mass % | 1.2 | 1.2 | 1.2 | 1.2 | 1.2 | 1.2 | 1.2 | 1.2 |
| equivalent to P element | mass % | (0.085) | (0.085) | (0.085) | (0.085) | (0.085) | (0.085) | (0.085) | (0.085) |
| Ag content in the Oil after ISOT test | mass ppm | 20 | 31 | 21 | 7 | 37 | 2 | 5 | 12 |

| | | Example 9 | Comparative example 1 | Comparative example 2 | Comparative example 3 | Comparative example 4 | Comparative example 5 |
|---|---|---|---|---|---|---|---|
| Lubricant base oil 1 (※1) | mass % | | remaining part | remaining part | remaining part | remaining part | remaining part |
| Lubricant base oil 2 (※2) | mass % | | | | | | |
| Lubricant base oil 3 (※3) | mass % | remaining part | | | | | |
| (A-1) Metallic detergent (※4) | mass % | 1.8 | 0.9 | 1.8 | — | 1.8 | 1.8 |
| equivalent to Ca element | mass % | 0.21 | 0.10 | 0.21 | — | 0.21 | 0.21 |
| (A-2) Metallic detergent (※5) | mass % | — | — | — | — | — | — |
| equivalent to Ca element | mass % | — | — | — | — | — | — |
| (A-3) Metallic detergent (※6) | mass % | — | — | — | — | — | — |
| equivalent to Ca element | mass % | — | — | — | — | — | — |
| (B-1) Succinimide (※7) | mass % | — | — | — | — | — | — |
| (B-2) Boric acid-modified succinimide (※8) | mass % | 4 | 4 | — | 4 | 6 | — |
| (B-3) Boric acid-modified succinimide (※9) | mass % | — | — | 4 | — | — | — |
| (B-4) Boric acid-modified succinimide (※10) | mass % | — | — | — | — | — | 4 |
| equivalent to nitrogen (N) element | mass % | 0.05 | 0.05 | 0.07 | 0.05 | 0.08 | 0.06 |
| equivalent to boron (B) element | mass % | 0.02 | 0.02 | 0.035 | 0.02 | 0.03 | 0.05 |

TABLE 1-continued

| | | | | | | | |
|---|---|---|---|---|---|---|---|
| B/N ratio | | 0.40 | 0.40 | 0.50 | 0.40 | 0.38 | 0.83 |
| M/N ratio | | 4.2 | 2.0 | 3.0 | — | 2.6 | 3.5 |
| (C-1) Zinc dialkyl dithiophosphate ※11) | mass % | 1.2 | 1.2 | 1.2 | 1.2 | 1.2 | 1.2 |
| equivalent to P element | mass % | (0.085) | (0.085) | (0.085) | (0.085) | (0.085) | (0.085) |
| Ag content in the Oil after ISOT test | mass ppm | 55 | 150 | 99 | 200 | 300 | 99 |

※1) Hydrocracked base oil (Kinematic viscosity at 100° C.: 6.5 $mm^2/s$, Viscosity index: 134, Sulfur (S) content: 50 mass ppm or less)
※2) PAO (Kinematic viscosity at 100° C.: 5.8 $mm^2/s$, Viscosity index: 138, S content: 50 mass ppm or less)
※3) Solvent-refined base oil (Kinematic viscosity at 100° C.: 7.3 $mm^2/s$, Viscosity index: 96, S content: 6200 mass ppm)
※4) Ca sulfonate (Ca content: 12.3 mass %, TBN: 300 mgKOH/g)
※5) Ca phenate (Ca content: 9.25 mass %, TBN: 230 mgKOH/g)
※6) Ca salicylate (Ca content: 6.0 mass %, TBN: 170 mgKOH/g)
※7) Polybutenyl succinimide (number average molecular mass of polybutenyl: 1300, N content: 1.7 mass % (bis))
※8) Number average molecular mass of polybutenyl: 1300, N content: 1.3 mass %, B content: 0.5 mass % (bis)
※9) Number average molecular mass of polybutenyl: 1300, N content: 1.7 mass %, B content: 0.87 mass % (bis)
※10) Number average molecular mass of polybutenyl: 1300, N content: 1.45 mass %, B content: 1.30 mass % (bis)
※11) Alkyl group: sec-butyl/sec-hexyl, P content: 7.2 mass %, S content: 15.2 mass %, Zn content: 7.8 mass %)

As clearly seen from Table 1, when the lubricating oil compositions of the present invention (Examples 1-9) were used, the amount of silver elution into the test oil measured after oxidation stability test was small. On the other hand, in cases where metallic detergent is excluded (Comparative example 3), the additive amount of the metallic detergent is less than the lower limit (Comparative example 1), the boron content is excessive (Comparative examples 2 and 5), and the nitrogen content is excessive (Comparative example 4), the amount of silver elution into the test oil measured after oxidation stability test was large. As a consequence, the compositions of comparative examples are poor in anticorrosive property against silver-containing material.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that lubricating oil composition with such an alternation are included in the technical scope of the invention.

INDUSTRIAL APPLICABILITY

Since the lubricating oil composition of the invention can inhibit corrosion of the silver-containing material which the lubricating oil composition is in contact with, when using the lubricating oil composition as a lubricating oil, it is possible to protect silver-containing material as well as machines and devices including silver-containing material. In addition, since the lubricating oil composition contains zinc dialkyl dithiophosphate, it is possible to inhibit sulfidation corrosion while maintaining the anti-wear property and the antioxidant characteristic. Therefore, the lubricating oil composition can be suitably used as lubricating oil for various internal combustions: particularly diesel engine; diesel engine for railway car; gasoline engine for automobile; and four-cycle two-wheel vehicle engine.

The invention claimed is:

1. A lubricating oil composition in contact with a silver-containing material, which comprises:

a lubricant base oil made of a hydrocracked mineral base oil and/or a poly-α-olefin, sulfur content in said lubricant base oil being less than 50 ppm;

(A) one or more metallic detergent selected from the group consisting of calcium phenate, calcium sulfonate, and calcium salicylate;

(B) one or more species of alkenyl succinimide and/or boron-containing alkenyl succinimide; and (C) zinc dialkyl dithiophosphate, wherein the content of these components to the total mass of the lubricating oil composition are defined as, (A) component: 0.15-0.4 mass % as metal content;

(B) component: 0-0.03 mass % as boron content, 0.005 mass % to 0.07 mass % as nitrogen content, and the mass ratio (B/N) between the boron content (B) and the nitrogen content (N) is 0-0.55; and (C) component: 0.02-0.10 mass % as phosphorus content, and mass ratio (M/N) between the metal content (M) attributed to the (A) component and the nitrogen content (N) attributed to the (B) component is 3.0 to 8.4.

2. The lubricating oil composition according to claim wherein the (A) component is selected from the group consisting of: calcium phenate and calcium salicylate.

3. The lubricating oil composition according to claim 2, wherein the (A) component is calcium phenate.

4. A method for protecting a silver-containing material in contact with a lubricating oil, the method comprising the step of: bringing a lubricating oil composition according to claim 1 as a lubricating oil into contact with a silver-containing material.

* * * * *